US005727916A

United States Patent [19]

Krebs et al.

[11] Patent Number: 5,727,916

[45] Date of Patent: Mar. 17, 1998

[54] METHOD FOR FEEDING AND ADVANCING OF A STRIP AND STRIP FEEDER FOR CARRYING OUT THE METHOD

[75] Inventors: Roland Krebs, Fraubrunnen; Peter Lehmann, Kirchdorf; Rudolf Lüthi, Niederwangen, all of Switzerland

[73] Assignee: Styner & Bienz AG, Niederwangen, Switzerland

[21] Appl. No.: 636,823

[22] Filed: Apr. 23, 1996

Related U.S. Application Data

[63] Continuation of Ser. No. 263,069, Jun. 21, 1994, abandoned.

[30] Foreign Application Priority Data

Jun. 21, 1993 [CH] Switzerland ..... 01863/93

[51] Int. Cl.[6] ..... B23Q 15/00

[52] U.S. Cl. ..... 414/19; 414/786; 198/744

[58] Field of Search ..... 414/19, 18, 797.8, 414/797.9, 786; 198/744, 741, 429, 430, 718; 271/269, 84

[56] References Cited

U.S. PATENT DOCUMENTS

| | | | |
|---|---|---|---|
| 3,311,370 | 3/1967 | Hunter | 271/84 X |
| 3,757,961 | 9/1973 | Jacobs | 198/741 X |
| 4,075,949 | 2/1978 | Davis et al. | 198/744 X |
| 4,090,703 | 5/1978 | Straube . | |
| 4,397,598 | 8/1983 | Ess et al. | 271/269 X |
| 4,828,101 | 5/1989 | Fluck | 198/429 |
| 5,092,449 | 3/1992 | Bolin et al. | 198/430 |

FOREIGN PATENT DOCUMENTS

| | | | |
|---|---|---|---|
| 409151A1 | 1/1991 | European Pat. Off. . | |
| 2632887 | 12/1989 | France . | |
| 1203029 | 10/1965 | Germany | 271/84 |
| 8220431 | 5/1985 | Germany . | |

*Primary Examiner*—Donald W. Underwood
*Attorney, Agent, or Firm*—Foley & Lardner

[57] ABSTRACT

Strips which are to be worked in a forming tool are taken out of a magazine and deposited on a guide at which by means of a finger rod with elastic catchs they are guided to the tool and stepwise advanced through said tool. By means of the programmable driving for the finger rod, this finger rod can execute strokes in any direction and in any different dimensions in order to guide the strips in the forming tool and for displacing them stepwise through the tool. The stripfeeder is of simple construction and it can be programmed for the most different requirements in that only the driving will be correspondingly programmed.

9 Claims, 2 Drawing Sheets

METHOD FOR FEEDING AND ADVANCING OF A STRIP AND STRIP FEEDER FOR CARRYING OUT THE METHOD

This application is a continuation of application Ser. No. 08/263,069 filed Jun. 21, 1994 now abandoned.

BACKGROUND OF THE INVENTION

The present invention relates to a method and a device for feeding and advancing of a strip through a reshaping tool whereby by means of at least one conveyor means one feeds and advances said strip stepwise and whereby said conveyor means is submitted by a programmable driving mechanism to conveying motions with different strokes. The invention relates also to a strip feeder for carrying out the method. Methods and strip feeders respectively of this kind are known e.g. from DE-U-8 220 431 or EP-A- 0 409 151. In both cases there is provided a rotating conveying element, that is a belt resp. a drum and these conveying elements must, provided they are equiped with a driving pin and after the stepwise advancing of a strip, run back by the full way, in order to be capable to seize a new strip. If conveying drums are provided it is practically not possible to move in all cases strips or similar parts with precision and to feed the rear end of the latter near enough to a tool.

SUMMARY OF THE INVENTION

It is an object of the present invention to avoid the known drawbacks by means of a simple construction. This object is reached in that a finger rod is used as conveying means to which different forward and backward strokes are imparted and which comprises many staggered fingers in the direction of the motion whereby the strip is conveyed with different fingers and strokes.

Due to the fact that the finger rod comprises many fingers in the longitudinal direction or direction of motion which lie preferably at different distances from each other, this gives rise to great liberties in the configuration of the program and limited steps of e.g. maximal 400 mm only are necessary, which may be executed rapidly.

BRIEF DESCRIPTION OF THE DRAWINGS

The invention will be further explained by means of an example of execution illustrated in the drawings.

DETAILED DESCRIPTION OF THE INVENTION

Figure 1:
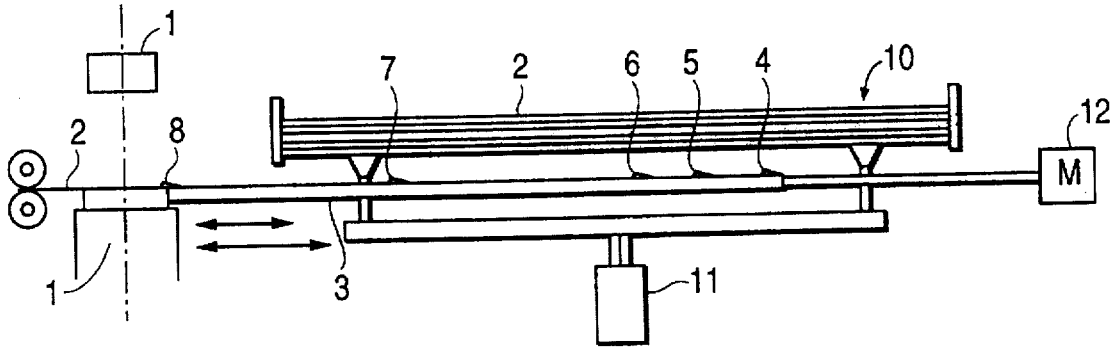
FIG. 1 is a schematic side view of the strip feeder according to the invention and of an associated reshaping tool.

FIG. 1 shows a reshaping tool 1, e.g. for punching of washers from the strips 2. The strips 2 have a usual form with undulated sides from which for an optimal utilization according to FIG. 2 e.g., two rows of washers shifted in the longitudinal direction and the transverse direction can be punched. It is clear that another kind of working, e.g. a deformation of the material can be executed. The strip feeder comprises a finger rod 3 which in the example of execution is provided with five elastic fingers or catches 4–8. These fingers protrude in the unloaded condition under spring effect over the finger rod 3 and can grasp a strip 2 by its backward edge and take it along and the fingers which are covered by a strip are pressed into the finger rod 3. The three backward fingers 4–6 in the advancing direction lie in a smaller mutual distance than the forward fingers 6, 7 and 8. The most frontal finger 8 lies at the forward end of the finger rod 3 and can thus insert a strip 2 according to FIG. 2 in the last position for punching the last washer or for working the last piece in a strip, without coming into collision with the forming tool. The rest of the grid of the strip of which all pieces have been punched is removed from the forming tool by means of a pair of removal drums 9. The strips 2 are removed individually from a magazine 10 by means of a vertical stacker 11 in a known way and deposited on a guiding track on which they are grasped by the fingers of the finger rod 3 and brought to the forming tool 1. The finger rod 3 is connected to a programmable linear drive 12 which can execute a full program of any forward and backward strokes as indicated in FIG. 1 by arrows of different lengths.

Figure 2:
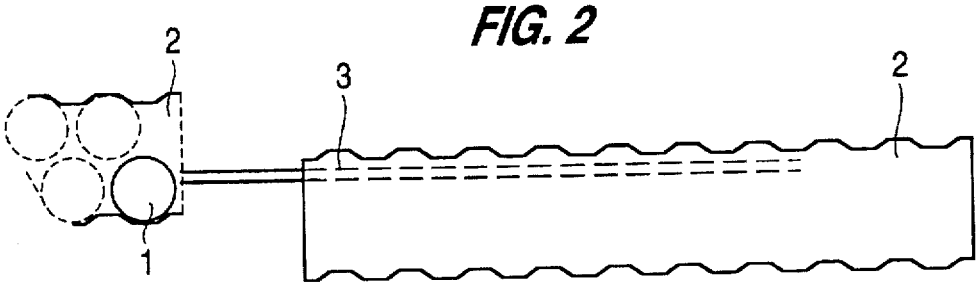
FIGS. 2–5 show different working conditions when feeding and working a strip.
Figure 3:
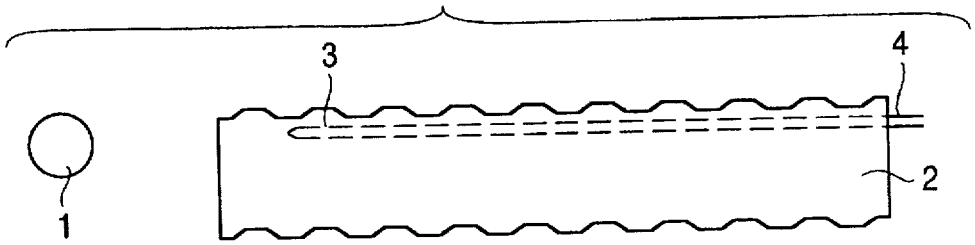
Figure 4:
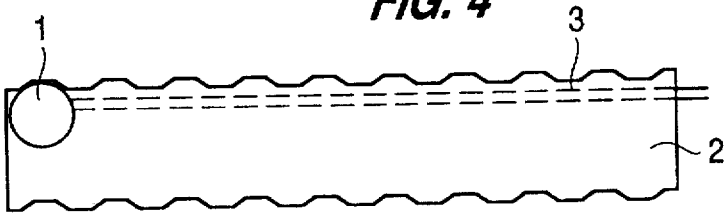
Figure 5:
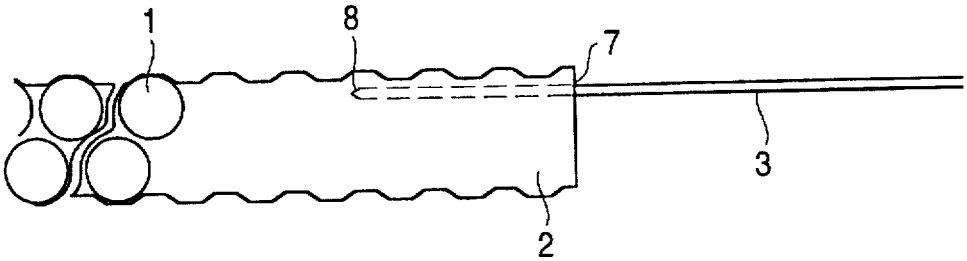

As already mentioned, FIGS. 1 and 2 show the condition by which a strip 2 is inserted in the forming tool. The most frontal tooth 8 at the forward end of the finger rod 3 is at the immediate vicinity of the forming tool without coming into conflict with it. The finger rod can be already withdrawn before the working stroke of the forming tool, if necessary. In FIG. 2, the position of a new applied strip 2 is visible. Under this strip, the finger rod 3 is withdrawn by a relatively great stroke into the position according to FIG. 3, position in which the most backward finger 4 of the finger rod 3 just engages behind the rear edge of the strip 3. The finger rod 3 with the strip 2 is then displaced forward by practically the same stroke into the position according to FIG. 4. In this way, the strip 2 is advanced far enough into the forming tool so that the first working operation can take place. The finger rod 3 is now in immediate vicinity of the forming tool 1 and it must then be withdrawn again for permitting further pushing forward of the strip 2. The next finger 5 or the next but one finger 6 can then come into service in order for the strip to be further stepwise pushed forward. FIG. 5 shows a further state in which the strip 2 is already partially worked and in which the finger rod 3 is enough withdrawn for a further stepwise pushing forward of the strip 2, that the finger 7 becomes active for further pushing forward of the strip. In a later state, the finger rod 3 must again be withdrawn in order for the finger 8 to come into service at the front end of the finger rod 3, in order to push forward the strip into the end position according to FIGS. 1 or 2.

Due to the configuration of the finger rod and due to its programmable driving, any condition can be fulfilled, e.g. advancing steps of different dimensions, also advancing strokes of different dimensions for feeding strips of different lengths. The guiding of the strip can be moved if necessary transversally with respect to the advancing direction, in order to permit the working of the strip in one or more rows of the strip.

Figure 6:
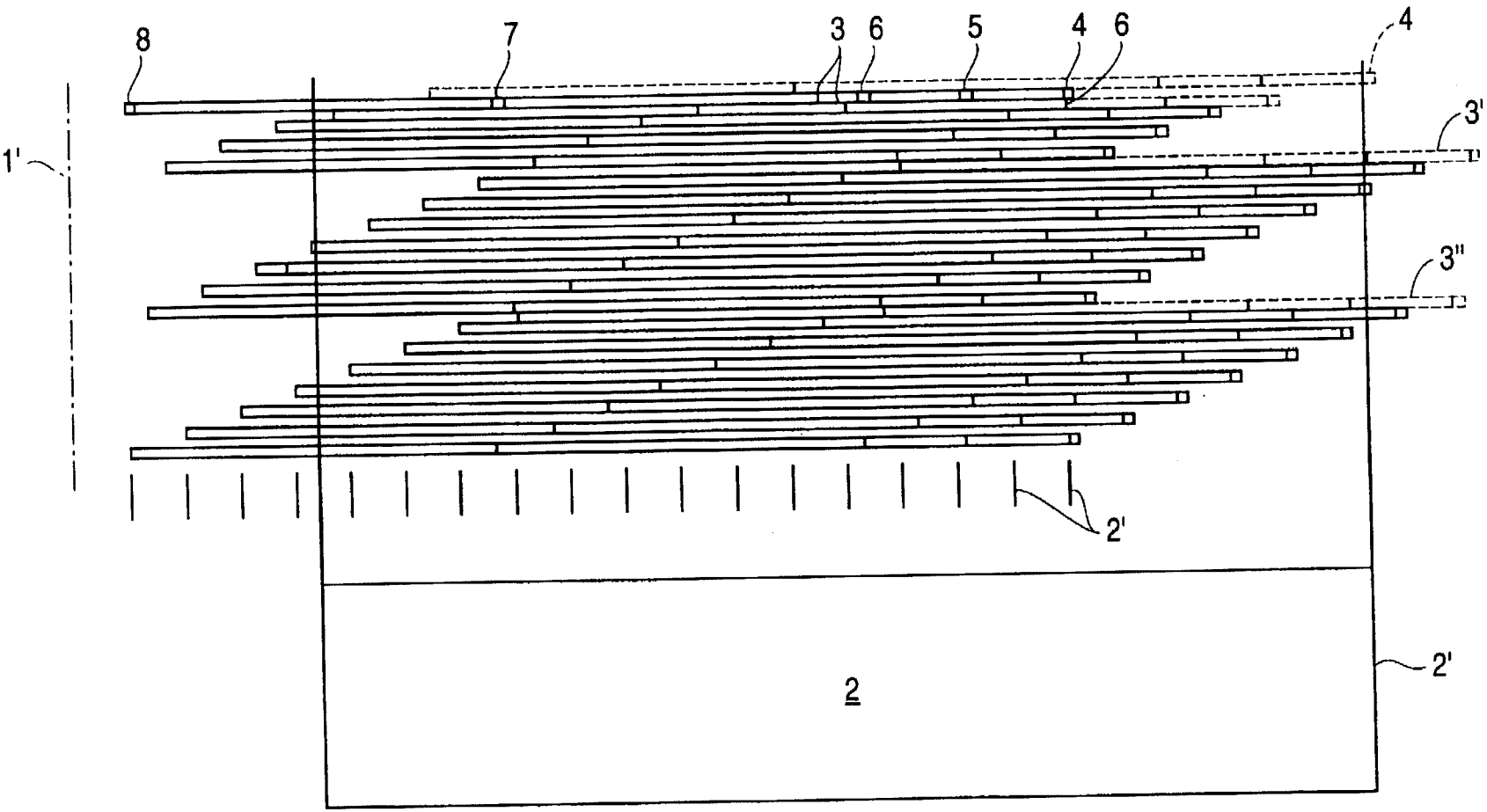
FIG. 6 shows the different operating positions during a working cycle of the strip feeder.

FIG. 6 shows a possible complete motion cycle of the finger rod 3 whereby the positions of advancing or feeding of the finger rod are shown in full lines while the backward positions are illustrated in dashed lines. The corresponding positions of the rear edge 2' of the strip 2 are illustrated below the finger rods 3. FIG. 6 illustrates at its top the withdrawn starting position of the finger rod according to FIG. 3, the position in which the finger 4 seizes the strip 2 in the illustrated position. The next position in which all the fingers 4–8 are still illustrated, corresponds to the first position of working according to FIG. 4, in which the strips have been fed by the finger 4. Then the finger rod is already withdrawn again in the position in which the finger 6, from which only the front edge is illustrated, seizes the strip. Three further positions follow whereby the finger 6 advances the strip each time by a step. Then the finger rod is again withdrawn in the position 3' in which the finger 7 seized the strip and displaced it forward by seven further steps. Then the finger rod is again withdrawn in the position 3' in which the most frontal finger 8 seizes the strip 2 and displaced it by seven further steps in the end position according to FIGS. 1 and 2.

As an advancing means, a toothed belt could be foreseen which would correspondingly be displaced by a to and fro motion. Up to now, it was admitted that a unique advancing means, e.g. a sole finger rod was present. However, for advancing broader strips or slabs, many advancing means, e.g. finger rods could be arranged, one adjacent the other, these means being of same configuration and motion.

We claim:

1. A method for feeding and advancing a strip into and through a reshaping tool, comprising the steps of:

successively driving a finger rod in forward and backward strokes distances of varying lengths in response to a programmable linear drive connected to said finger rod;

engaging a rear edge of said strip with one of a plurality of fingers arranged along the length of said finger rod each time said finger rod moves forward in the direction of advancing said strip; and moving backward said finger rod a length equal to the distance between said finger which is engaged with said rear edge and a neighboring said finger which is situated beneath said strip, said length of said backward movement of said finger rod during some of said backward strokes for feeding said strip exceeding a length of said forward strokes.

2. The method according to claim 1, wherein said finger rod moves backward for small distances when a distance between the rear edge of said strip and the reshaping tool is long and moves backward for longer distances when the distance between the rear edge of said strip and the reshaping tool is short.

3. A method for feeding and advancing a strip into and through a reshaping tool, comprising the steps of:

providing a feeding member having a number of fingers for engaging a rear edge of said strip for advancing and feeding the same in a feeding direction, said fingers being staggered in said feeding direction, a drive connected to said feeding member and a programmable control means for controlling said drive to move said feeding member in forward and backward strokes;

advancing said strip by steps during its passage through said tool by forward strokes of said feeding member, such forward strokes being of equal length with said steps of the strip; and repeatedly retracting said feeding member during said passage of said strip through said tool by respective backward strokes of a length exceeding the length of the steps by which said strip is advanced, thereby avoiding a backward stroke of the sum of forward strokes at the end of said passage of the strip through the tool.

4. The method according to claim 3, further comprising the steps of:

providing a finger rod as said feeding member; and repeatedly retracting said finger rod during said passage of said strip through said tool by backward strokes exceeding the steps by which said strip is advanced whenever said finger rod advances into proximity of said tool.

5. A device for feeding and advancing a strip in a feeding direction into and through a reshaping tool, comprising:

a finger rod extending in said feeding direction and having a number of fingers staggered in the feeding direction for engaging a rear edge of said strip for advancing the same; and a programmable drive connected to said finger rod for executing forward and backward strokes of said finger rod, said drive being programmable for imparting to said finger rod forward strokes for advancing said strip by steps of determined length and for imparting to said finger rod backward strokes each of said backward strokes having a length exceeding the determined length of each of said steps, said finger rod having adjacent fingers spaced by a distance exceeding said determined length of each of said steps.

6. The device according to claim 5, wherein said adjacent fingers of said finger rod are spaced by a multiple of said determined length of each of said steps.

7. The device according to claim 5, wherein the number of fingers on said finger rod comprises five fingers.

8. The device according to claim 7, wherein adjacent fingers on said finger rod have different distances from each other.

9. The device according to claim 8, wherein said different distances are smaller between adjacent fingers at a rear end of said finger rod relative to the feeding direction of said strip, and are larger between adjacent fingers at a front end of said finger rod.

* * * * *